US010056218B1

(12) United States Patent
Hewitt et al.

(10) Patent No.: US 10,056,218 B1
(45) Date of Patent: Aug. 21, 2018

(54) GRAPHENE/GRAPHITE-BASED FILAMENT FOR THERMAL IONIZATION

(71) Applicant: Savannah River Nuclear Solutions, LLC, Aiken, SC (US)

(72) Inventors: Joshua T. Hewitt, Aiken, SC (US); Gregory Hall, Aiken, SC (US); Charles R. Schick, Jr., Aiken, SC (US)

(73) Assignee: Savannah River Nuclear Solutions, LLC, Aiken, SC (US)

( * ) Notice: Subject to any disclaimer, the term of this patent is extended or adjusted under 35 U.S.C. 154(b) by 0 days.

(21) Appl. No.: 15/435,976

(22) Filed: Feb. 17, 2017

(51) Int. Cl.
*H01J 1/14* (2006.01)
*H01J 49/16* (2006.01)
*H01J 1/15* (2006.01)

(52) U.S. Cl.
CPC ..... *H01J 1/14* (2013.01); *H01J 1/15* (2013.01); *H01J 49/16* (2013.01)

(58) Field of Classification Search
CPC ..... H01J 1/13; H01J 1/14; H01J 1/142; H01J 1/144; H01J 1/146; H01J 1/15; H01J 49/10; H01J 49/16; H01J 49/268
See application file for complete search history.

(56) References Cited

U.S. PATENT DOCUMENTS 4,047,101 A 9/1977 Bauerle et al.
4,156,814 A * 5/1979 Hunt ..... H01J 49/142 250/288
5,313,067 A 5/1994 Houk
5,756,996 A * 5/1998 Bier ..... H01J 49/145 250/286
6,670,624 B1 * 12/2003 Adams ..... C23C 14/48 250/200
6,885,010 B1 4/2005 Traynor et al.
7,323,682 B2 1/2008 McCauley et al.
8,784,737 B2 7/2014 Rafferty et al.
9,000,364 B2 4/2015 Ermakov et al.
9,159,542 B2 10/2015 Mullen et al.
9,165,721 B2 * 10/2015 Lee ..... H01G 11/36
9,284,193 B2 3/2016 Cruz-Silva et al.
9,327,983 B2 5/2016 Kwon et al.
(Continued)

FOREIGN PATENT DOCUMENTS

CN 203367223 12/2013
WO WO 2015/100221 7/2015

OTHER PUBLICATIONS

Yao et al, "Three Dimensional Printable High-Temperature and High-Rate Heaters", ACS Nano, vol. 10, 2016.*
(Continued)

*Primary Examiner* — David E Smith
(74) *Attorney, Agent, or Firm* — Dority & Manning P.A.

(57) ABSTRACT

Methods and systems for thermal ionization of a sample and formation of an ion beam are described. The systems incorporate a thermal ionization filament that is formed of a graphene-based material such as graphite, graphene, graphene oxide, reduced graphene oxide or combinations thereof. The filament material can be doped or chemically modified to control and tune the work function of the filament and improve ionization efficiency of a system incorporating the filament. The systems can be utilized in forming an ion beam for target bombardment or analysis via, e.g., mass spectrometry.

19 Claims, 3 Drawing Sheets

(56) References Cited

U.S. PATENT DOCUMENTS

| | | | | |
|---|---|---|---|---|
| 9,734,980 | B2 * | 8/2017 | Li | H01J 35/065 |
| 2009/0166523 | A1 | 7/2009 | Bachmann et al. | |
| 2010/0301212 | A1 | 12/2010 | Dao et al. | |
| 2011/0127471 | A1 | 6/2011 | Shin et al. | |
| 2012/0326022 | A1 * | 12/2012 | Kumano | H01J 49/0409 250/282 |
| 2013/0214147 | A1 * | 8/2013 | Mullen | H01J 49/147 250/282 |
| 2014/0087501 | A1 | 3/2014 | Chen et al. | |
| 2015/0064463 | A1 | 3/2015 | Wu et al. | |
| 2015/0276677 | A1 | 10/2015 | Li et al. | |
| 2015/0368804 | A1 * | 12/2015 | Lee | C23C 18/1676 264/105 |
| 2016/0325543 | A1 | 11/2016 | Casiraghi et al. | |

OTHER PUBLICATIONS

Duan et al, "Characterization of an Improved Thermal Ionization Cavity Source for Mass Spectrometry", J. Am. Soc. Mass Spectrom., 1999, 10.*

Calsteren, Peter, "Thermal Ionization Mass Spectroscopy", Encyclopedia of Earth Science, pp. 623-624, 1998.*

Yao et al, "Three-Dimensional Printable High-Temperature and High-Rate Heaters", ACS Nano, vol. 10, 8 pages.*

Chandran, K.S. Ravi, "Transient Joule heating of graphene, nanowires and filaments: Analytical model for current-induced temperature evolution including substrate and end effects", International Journal of Heat: and Mass Transfer, vol. 88, Sep. 2015, 3 pages.

Duan et al.. "Characterization of an Improved Thermal Ionization Cavity Source for Mass Spectrometry", J. Am. Soc. Mass Spectrom., 1999, 10, 8 pages.

Hummers et al., "Preparation of Graphitic Oxide", J. Am. Chem. Soc., vol. 80, Issue 6, 1958, p. 1339.

Kong et al., "Applications of Grapliene in Mass Spectrometry", Journal of Nanoscience and Nanotechnology, vol. 14, No. 7, Jul. 2014.

Kumar et al. "The impact of functionalization on the stability, work function, and photolurninescence of reduced graphene oxide", ACS Nano, Feb. 26, 2013, pp. 1638-1645.

Machine Translation of CN203367223 dated Dec. 25, 2013, 8 pages.

Marcano et al., "Improved Synthesis of Graphene Oxide", ASC Nano, vol. 4, Jul. 22, 2010, pp. 4806-4814.

Peleg, Roni, "World's First commercial Conductive Graphene Filament for 3D Printing", 3Dprinting.com, Mar. 18, 2015, 4 pages.

Sygellou et al., "Work Function Tuning of Reduced Graphene Oxide Thin Films", J. Phys. Chem., Dec. 8, 2015 pp. 281-290.

Wu et al,, "Graphene nanosheet mediated MALDI-MS (GN-MALDI-MS) for rapid, in situ detection of intact incipient biofilms on material surfaces", Materials Science and Engineering, Sep. 1, 2016, 3 pages.

Yao et al., "Three-Dimensional Printable High-Temperature and High-Rate Heaters", ACS Nano, vol. 10, 8 pages.

* cited by examiner

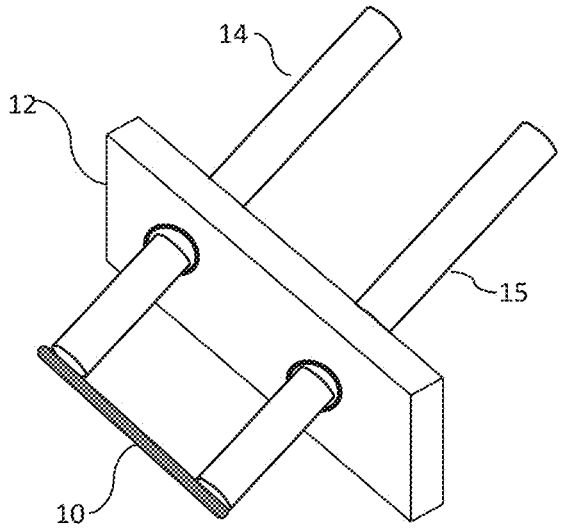
FIG. 1
FIG. 2
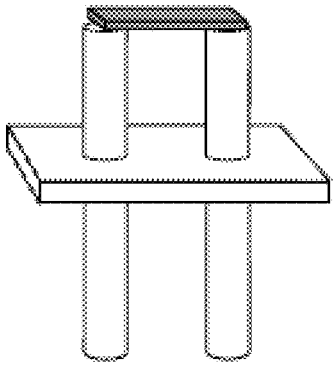
FIG. 3
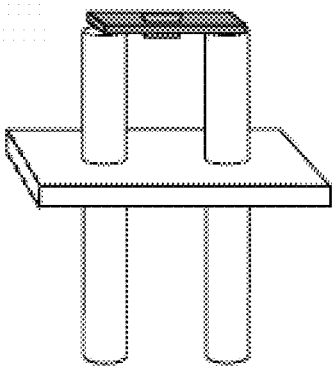
FIG. 4
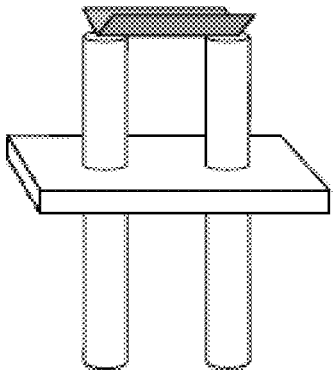
FIG. 5
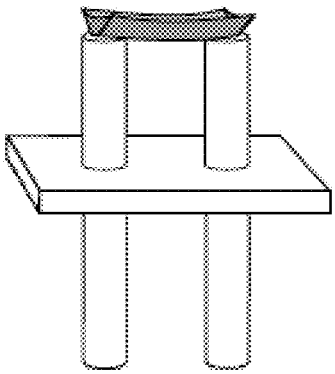

FIG. 6
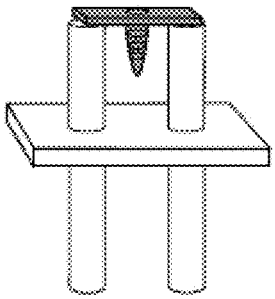
FIG. 7
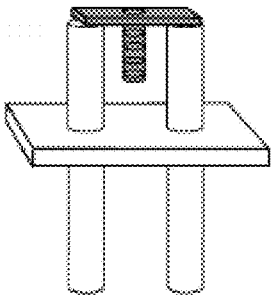
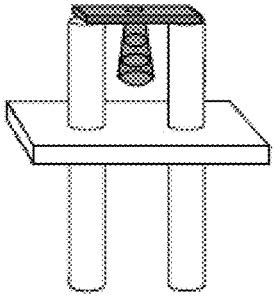
FIG. 8
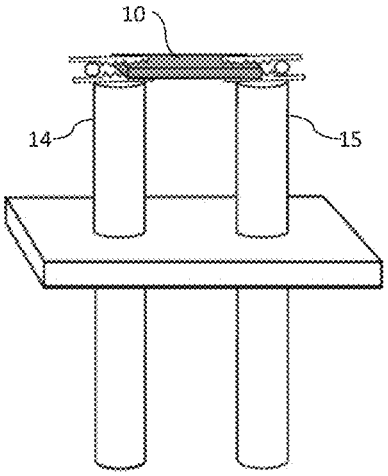
FIG. 9
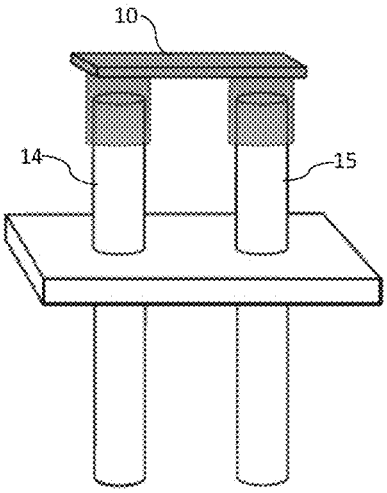
FIG. 10

GRAPHENE/GRAPHITE-BASED FILAMENT FOR THERMAL IONIZATION

FEDERAL RESEARCH STATEMENT

This invention was made with government support under Grant No. DE-AC09-08SR22470 awarded by the U.S. Department of Energy. The government has certain rights in the invention.

BACKGROUND

Thermal ionization utilizes resistive heating of a filament to desorb and spontaneously ionize elemental species from a solid sample located in contact with the filament. In an analytical protocol, the desorbed ions are collected via acceleration and focusing to form an ion beam that is directed to a mass spectrometer. Thermal ionization mass spectrometry (TIMS) is the benchmark technique for determination of isotope ratios of elements in geochronology and tracer studies. For example, TIMS is commonly utilized in analysis of radiometric systems including U→Th→Pb, Rb→Sr, Sm→Nd, Lu→Hf, and the uranium series disequilibrium. TIMS is also useful in analysis of non-terrestrial systems in determining the decay of short-lived radionuclides as found in meteorites such as Fe→Ni, Mn→Cr, Al→Mg, etc. Non-radiogenic, stable isotope ratios for various elements such as Li, B, Mg, Ca, and Fe are also often characterized by use of TIMS in order to, e.g., characterize exchange processes, track reservoir interaction and evaluate kinetic processes.

While TIMS offers many benefits to analytics including very precise measurements, consistent mass fractionation, highly automated operation, and near 100% transmission of ions from the source to the collector, disadvantages exist. One particular issue that continues to plague TIMS is low ionization efficiency at the ion source. For many elements (e.g. uranium and plutonium) only a very small fraction of the analytical sample, on the order of 0.1% to 0.2%, is ionized and subsequently detected. Other disadvantages of TIMS are directly or indirectly tied to the low ionization efficiency of the systems such as limits on sample materials, with a difficulty in using the technique with elements that exhibit large first ionization potentials; and a requirement for extensive sample preparation in order to obtain pure enough samples such that ionization is not affected by contaminate elements or isobars.

What are needed in the art are systems and methods that can increase the ionization efficiency during thermal ionization of a sample. In particular, systems and methods that incorporate thermal ionization filaments formed of materials and/or having a geometry that can increase efficiency of the system would be of great benefit. This would be particularly beneficial for expanding the capabilities of TIMS.

SUMMARY

According to one embodiment, disclosed is a system for ionizing a sample that includes a graphene thermal ionization (TI) filament. As utilized herein, a graphene TI filament is a filament that incorporates a graphene-based material at a surface of a filament, e.g., graphene, graphene oxide, or reduced graphene oxide, that can be single or multi-layer (i.e., graphene or graphite) and can optionally be doped or chemically modified, and including a metal hybrid of a graphene-based material. For instance, the graphene-based material can be coated on a metal substrate to form a composite graphene TI filament, or the entire filament can be formed of a graphene-based material. A system can also include a power source in electrical communication with the graphene TI filament that is configured for resistively heating the graphene TI filament. In addition, a system can include an ion collector, e.g., a series of lens elements, in communication with the graphene TI filament such that ions emitted from the graphene TI filament can pass through the ion collector to form an ion beam. Optionally, a system can also include a mass spectrometer in communication with the ion collector such that ions that pass through the ion collector can subsequently enter a magnetic field of the mass spectrometer.

Also disclosed is a method for forming an ion beam that can include contacting a graphene TI filament with a solid sample and resistively heating the graphene TI filament to a temperature at which atoms of the sample are desorbed and ionized. A method can also include collecting and focusing the desorbed ions to form the ion beam. Optionally, a method can further include analyzing the ions of the sample. For instance, the method can include passing the ion beam through a magnetic field in order to separate the ions of the ion beam according to their mass to charge ratio.

BRIEF DESCRIPTION OF THE FIGURES

A full and enabling disclosure of the present subject matter, including the best mode thereof to one of ordinary skill in the art, is set forth more particularly in the remainder of the specification, including reference to the accompanying figures in which:

FIG. 1 schematically illustrates one embodiment of a graphene TI filament configuration in a system as described.

FIG. 2 illustrates a possible shape for a graphene TI filament.

FIG. 3 illustrates another possible shape for a graphene TI filament.

FIG. 4 illustrates another possible shape for a graphene TI filament.

FIG. 5 illustrates another possible shape for a graphene TI filament.

FIG. 6 illustrates another possible shape for a graphene TI filament.

FIG. 7 illustrates another possible shape for a graphene TI filament.

FIG. 8 illustrates another possible shape for a graphene TI filament.

FIG. 9 illustrates a possible electrical connection for a graphene TI filament.

FIG. 10 illustrates another possible electrical connection for a graphene TI filament.

Figure 11:
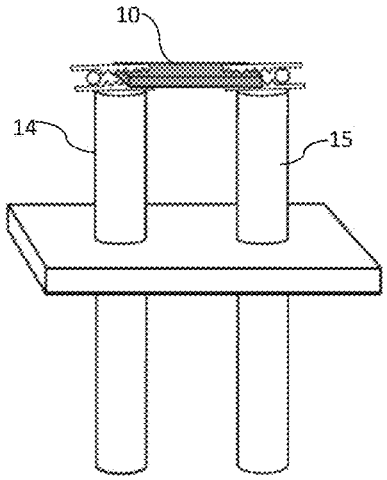
FIG. 11 illustrates another possible electrical connection for a graphene TI filament.

Repeat use of reference characters in the present specification and drawings is intended to represent the same or analogous features or elements of the present invention.

DETAILED DESCRIPTION

Reference will now be made in detail to various embodiments of the disclosed subject matter, one or more examples of which are set forth below. Each embodiment is provided by way of explanation of the subject matter, not limitation thereof. In fact, it will be apparent to those skilled in the art that various modifications and variations may be made in the present disclosure without departing from the scope or spirit of the subject matter. For instance, features illustrated or described as part of one embodiment, may be used in another embodiment to yield a still further embodiment.

In general, the present disclosure is directed to thermal ionization methods and systems that incorporate TI filaments that can dramatically increase the efficiency of the thermal ionization process. More specifically, the systems and methods utilize a graphene TI filament, i.e., a filament that includes a graphene-based material such as graphene, graphene oxide, or reduced graphene oxide or combinations thereof at least at a surface of the filament. The graphene-based material can be in the form of a single layer material or a multi-layer material, i.e., graphene or graphite. A graphene TI filament can be formed only of the graphene-based material or can be a composite filament that includes a graphene-based material in conjunction with one or more additional materials. For instance, a graphene TI filament can be in the form of a composite in which the graphene-based material (e.g., graphene/graphene oxide/graphite) is supported on a metal, e.g., a typical TIMS metal (e.g. Re, W, Ta or other refractory metals). During use, both the upper layer containing a graphene-based material and the underlying meta layer can be restively heated as described further herein. In another embodiment, the graphene TI filament can include a metal-graphene hybrid that can form all or a portion of the filament, for instance as a coating on an underlying metal substrate. Metal-graphene hybrids have been described, for instance in U.S. Published Patent Application No. 2015/0368804 to Lee, et al., which is incorporated herein by reference.

The likelihood of ionization in a TI process is a function of the filament temperature, the work function of the filament substrate, and the ionization energy of the element of the sample. This relationship can be summarized by the Saha-Langmuir equation:

$$\frac{n_+}{n_o} = \frac{g_+}{g_o} e^{\frac{W-\Delta E_I}{kT}}$$

in which $$\frac{n_+}{n_o}$$

is the ratio of the ion number density ($n_+$) to neutral number density ($n_0$)

$$\frac{g_+}{g_o}$$

is the ratio of degenerate states for the ionic ($g_+$) and neutral ($g_0$) states W is the work function of the filament surface $\Delta E_I$ is the ionization energy of the desorbed element k is Boltzmann's constant T is the surface temperature of the filament The relationship between the ionization potential of the analyte element of the sample and the work function of the filament material will thus affect the ionization efficiency of the system, with small changes in the ($W-\Delta E_I$) term leading to large changes in the ratio of ions produced (i.e., the ionization efficiency).

By use of graphene-based materials to form a TI filament, the ionization efficiency of a TI process can be greatly enhanced, which can improve multiple aspects of a system. For instance, the graphene-based materials used to form the graphene TI filaments can be prepared and/or modified with dopants, chemical modifications, etc. so as to tune the work function of the filament material. This can dramatically improve the ionization efficiency of the process so as to exhibit a 2 or even 3 order of magnitude increase in efficiency as compared to traditional metal filament materials. This improved ionization efficiency can provide a route for development of reaction pathways and examination of elements not previously possible when utilizing traditional metal filaments. Moreover, the increased efficiencies can allow for successful ionization of smaller sample sizes than possible with previously known systems. In addition, by use of the graphene-based materials of formation, the TI filaments can be formed and shaped according to a variety of processing techniques, including additive manufacturing processes such as 3-D printing, which can provide a facile route to production of filament geometries that can further improve ionization efficiency as well as to improve focusing and capture of the desorbed ions.

As utilized herein, the term "graphene" generally refers to the crystalline allotrope of carbon in which individual carbon atoms of the structure are bound to three adjacent carbon atoms in an $sp^2$ hybridized manner so as to define a one atom thick planar carbon sheet in which the carbon atoms are arranged in the planar sheet in a honeycomb-like network of tessellated hexagons. The graphene-based materials of the graphene TI filaments can include a single layer of graphene on a suitable support structure, multiple layers of graphene on a suitable support structure, a macroscopic structure composted of many individual graphene flakes deposited/formed on a suitable support, or a macroscopic sized object created entirely from annealed graphene, annealed graphene oxide, and/or graphite. Annealing of graphene and reduced graphene oxide sheets can occur via a thermal mechanism, chemical mechanism, or some combination of the two. As such, throughout this specification, the term "graphene-based material" is intended to refer to a structure that includes a single graphene mono-layer either alone or in conjunction with other graphene mono-layers and including macroscopic objects composed of many individual graphene layers. For instance, a structure including up to about 10 individual monolayers can generally be referred to as "graphene" while a structure including about 10 or more individual monolayers can generally be referred to as "graphite," but both structures are considered herein to be graphene-based materials. In addition, the term is intended to refer to pure graphene that includes only carbon in the crystalline lattice structure as well as other derivatives thereof that could include additional elements such as and not limited to nitrogen, oxygen, sulfur, osmium, etc. in the lattice structure. The term also refers to graphene that includes derivative groups bonded to the ring structure including functional groups and coordination compounds thereof. As such, the term "graphene filament" is intended to refer to a high aspect ratio structure (e.g., with L/D greater than about 10) that includes a graphene-based material including, without limitation, graphite, graphene, graphene oxide or reduced graphene oxide as well as combinations, derivatives, and hybrids thereof at least at a surface of the structure.

Graphene for use in forming a graphene TI filament can be obtained according to standard methodology. Graphene is relatively hydrophobic and is conventionally formed either by exfoliation of graphite, which may be done using supercritical carbon dioxide or by micromechanical cleavage, or by epitaxial growth on silicon carbide or certain metal substrates. Graphene may also be formed in the gas phase by passing liquid droplets of ethanol into argon plasma in an atmospheric-pressure microwave plasma reactor (see, e.g., U.S. Patent Application Publication No. 2010/0301212 to Dato, et al., which is incorporated herein by reference).

Graphene oxide is a family of impure oxidized forms of graphene that can include hydroxyl and/or epoxide groups bonded to various carbon atoms in the lattice. The structural properties of graphene oxide have been extensively studied, but the exact chemical structure is still the subject of much debate and considerable variability, at least in terms of hydroxyl and epoxide group frequency and location. Graphene oxide of a filament can optionally include carboxylic acid groups, for instance at the edges of the carbon sheet(s). Such functional groups can provide a route for further chemical functionalization of the graphene oxide, described in more detail herein. Graphene oxide for use in forming a graphene IT filament can exhibit a wide range of oxidation levels, for instance with oxygen-to-carbon ratios up to about 1:2.

Graphene oxide can be prepared by the traditional treatment of graphite with potassium chlorate and fuming nitric acid. A somewhat more efficient process as may be used employs sulfuric acid, sodium nitrate, and potassium permanganate to convert graphite to graphene oxide (the Hummers method; see Hummers et al., "Preparation of Graphitic Oxide", J. Am. Chem. Soc., Vol. 80, p. 1339, 1958). A more efficient, modified Hummer's method as has been reported using sulfuric acid, phosphoric acid, and potassium permanganate is another example of a suitable formation method for obtaining graphene oxide (see Marcano et al., "Improved Synthesis of Graphene Oxide", ASC Nano, Vol. 4, pp. 4806-4814, 2010).

Reduced graphene oxide can also be utilized in a graphene IT filament. For instance, reduced graphene oxide with measured oxygen-to-carbon ratios as low as about 1:24 can be utilized in some embodiments. It is noteworthy that reduced graphene oxide has been observed to exhibit many chemical, physical, and electrical properties more similar to those of graphene than to those of graphene oxide.

Graphene oxide may be reduced by a number of different processes to produce reduced graphene oxide for disclosed methods and systems. For instance, colloidally-dispersed graphene oxide in water may be chemically reduced using hydrazine monohydrate. Other chemical reductants for graphene oxide include hydroquinone, gaseous hydrogen, and strongly basic solutions. Thermal exfoliation and reduction of graphene oxide occurs upon heating to 1050° C. with extrusion to remove the generated byproduct of carbon dioxide gas. Electrochemical reduction of graphene oxide may be accomplished by placing electrodes at opposite ends of a graphene oxide structure (e.g., a filament formed primarily of graphene oxide) on a non-conductive substrate, followed by the application of an electrical current to the structure.

FIG. 1 schematically illustrates one embodiment of a graphene TI filament 10 held in a frame as may be incorporated into a system for formation of an ion beam and optionally, for analysis of ions in the ion beam (e.g., a TIMS system). The graphene TI filament 10 can have a traditional, ribbon type shape as is common for metal filaments in traditional TI systems, and as illustrated in FIG. 1, or can have a different geometry and orientation, for instance as may encourage directional desorption of the ions and improved collection and focusing in formation of the ion beam. For example, a filament can be formed with a geometry that can maximize the surface area to volume ratio of the filament so as to increase ionization efficiency of the TI process. Examples of filament orientations and geometries include, without limitation, those illustrated in FIG. 2-FIG. 8 that include a "flat" filament (FIG. 2), a "dimple" filament (FIG. 3), a "vee" filament (FIG. 4), a "canoe" filament (FIG. 5), a "deep cone" filament (FIG. 6), a "deep cylinder" filament (FIG. 7), and an "asymmetric cone" filament (FIG. 8). Other examples of geometries as may be utilized in forming a filament have been described, for instance, in "Characterization of an Improved Thermal Ionization Cavity Source for Mass Spectrometry" J. Am. Soc. Mass Spectrom., 1999, 10, 1008-1015.

Variation of the shape of the graphene TI filament can be provided in one embodiment by use of an additive manufacturing process to form the filament. As utilized herein, the term "additive manufacturing" refers to any method for forming a graphene TI filament in which the graphene-based material of formation is deposited according to a controlled deposition and solidification process. The additive manufacturing process can generally include extrusion of the graphene-based material in the form of a concentrated solution or suspension (generally referred to herein as an ink) to produce a layer, followed by spontaneous or controlled curing of the extrudate in the desired pattern. In some methods, successive layers are individually solidified prior to deposition of the succeeding layer, with each successive layer becoming adhered to the previous layer during the solidification process. Alternatively, successive layers of the extrudate can be built up and the entire structure can be cured in a single process. In one embodiment, a 3-D printing process can be used in which the graphene-based formation material is extruded to form the successive layers of the filament. By way of example, an aqueous graphene ink can be extruded in the form of a suitably high viscosity liquid to form a single layer in the desired shape of the filament. Following, another layer or area of the ink can be applied, and so on to build the entire three-dimensional filament.

Graphene-based inks as may be utilized in forming a graphene TI filament have been described, for instance in U.S. Pat. No. 9,165,721 to Lee, et al. and in U.S. Patent Application Publication No. 2016/0325543 to Casiraghi, et al., both of which are incorporated herein by reference. For example, in one embodiment, a graphene oxide ink can be prepared by suspending graphene oxide (e.g. a commercially obtained graphene oxide or a graphene oxide formed from graphite according to standard methodology) in water under ultrasonic conditions. The graphene oxide can be in the form of flakes having lateral dimensions in any useful size. For instance, in some embodiments graphene-based flakes for use in an ink can be the range of about 1 μm or less, for instance from about 0.2 μm to about 0.8 μm. Smaller or larger flakes are also encompassed herein, however. For instance, large flakes on the order of about 0.5 μm or greater, for instance from about 0.5 μm to about 5 μm can be utilized in some embodiments as well as smaller, nano-sized graphene-based flakes of about 200 nm or less, about 100 nm or less, or even smaller in some embodiments. A water-based graphene-based ink can be stable for months, mostly due to the hydroxyl, epoxide and carboxyl functional groups naturally present on the surface of the graphene oxide. Water-based inks having up to about 1 wt. % graphene oxide or even higher may be used, but stability can decrease at higher graphene oxide concentrations. An ink can include the graphene-based material in a relatively high concentration so as to form the three-dimensional filament structures as desired. By way of example, in one embodiment, a graphene oxide ink can include the graphene oxide at a concentration of about 100 mg/mL in water or less, for instance about 80 mg/mL in some embodiments.

An ink can optionally include materials in addition to the graphene-based material and the solvent, for instance a dispersant, a viscosity modifier, a surface tension modifier, etc.

A dispersant can include in one embodiment a polycyclic aromatic compound as described in U.S. Patent Application Publication No. 2016/0325543, previously incorporated herein by reference. For instance, a dispersant can include a ring system that includes from 2 to 10 fused benzene rings, the ring system being substituted with from 1 to 4 independently selected hydrophilic groups, each hydrophilic group including less than 20 atoms that may be independently selected from S, O, P, H, C, N, B and I. Exemplary hydrophilic groups include $SO_3H$, $SO_2H$, $B(OH)_2$, $CO_2H$, OH and $PO_3H$. Generally, when the polyaromatic compound comprises multiple substituent groups, they are not all the same. The polycyclic aromatic compound may be a salt, e.g., a base addition salt. When present, the amount of a dispersant present in an ink can be from about $10^{-4}$ mol/L to about $200\times10^{-4}$ mol/L.

Examples of suitable viscosity modifiers include (and are not limited to) glycols (e.g. ethylene glycol, propylene glycol), ethers (e.g. ethylene glycol methyl ether), alcohols (e.g. 1-propanol), esters (ethyl lactate), ketones (e.g. methyl ethyl ketone (MEK)) and organo-sulphur compounds (e.g. sulfolane). When present, a viscosity modifier can be included in an ink in an amount of from about 0.1 wt. % to about 50 wt. % (e.g. about 0.1 wt. % to about 5 wt. %).

A surface tension modifier is suitably a water soluble surface active material. Examples of suitable materials include surfactants, generally non-ionic surfactants such as (and without limitation to) Triton®, Tween®, poloxamers, cetostearyl alcohol, cetyl alcohol, cocamide DEA, monolaurin, nonidet P-40, nonoxynols, decyl glucoside, pentaethylene glycol monododecyl ether, lauryl glucoside, oleyl alcohol, and polysorbate. When present, a surface tension modifier can be in the ink at an amount of from about 0.01 wt. % to about 2 wt. %.

The graphene ink can be printed by use of any suitable 3-D printer capable of programmable printing in three dimensions so as to build the graphene TI filament layer by layer. For example, a typical 3-D printing nozzle (e.g., about 300 μm diameter nozzle) with pressure controlled at about 60 psi can be utilized with the nozzle moving speed set from about 1 mm/sec to about 5 mm/sec. The dimensions of the filament can be input to the system and a plurality of layers (e.g., about 10 layers or more) can be successively deposited. Following deposition, the printed green structure can be freeze dried at a vacuum (e.g., about −50° C. and about 0.5 Pa) to remove the solvent and solidify the filament structure.

The graphene TI filament can be deposited directly onto any surface that is chemically inert to the graphene/solute mixture. Following deposition, the green structure will be annealed in order to maintain its shape. As such, the substrate upon which the graphene-based material is deposited will be one that can be stable at the high annealing temperatures. In addition, if the graphene is to be retained on the substrate as a composite graphene TI filament, the substrate should be one that can be stable at the high TIMS temperatures. By way of example, in one embodiment, the graphene-based material can be deposited directly an electrode of a TIMS system. In another embodiment in which the graphene TI filament is a composite structure, the graphene-based material can be deposited on a metal, e.g., a rhenium or tungsten substrate in formation of a composite graphene TI filament.

Of course, a graphene TI filament formation process is not limited to an additive manufacturing process, and any suitable formation method may alternatively be utilized. By way of example, in some embodiments, a graphene TI filament may be formed according to a graphene fiber spinning and/or casting process such as has been described, for instance in U.S. Pat. No. 9,284,193 and U.S. Patent Application Publication No. 2015/0064463, both of which being incorporated herein by reference.

Briefly, according to one exemplary embodiment, a colloidal graphene oxide dispersion or slurry that includes a high concentration of graphene oxide flakes (e.g., high enough that the flakes can spontaneously form a three-dimensional network) can be spread to a very thin layer on a casting plate (e.g., a polytetrafluoroethylene casting plate). Drying can be allowed to proceed naturally or can be accelerated by using forced convection of warm air in a controlled environment (e.g., less than 30% relative humidity). After drying, the film can be lifted off from the casting plate and the filaments can then be prepared by cutting the thus-formed film into the desired geometries.

According to another embodiment, a graphene filament can be formed according to a spinning process such as a spunlace process or an electric spinning process, in which a graphene oxide solution can be injected into a second solution that contains at least one cationic surfactant, at least one cation and optionally an acidic reductant. As the first solution including the graphene oxide flakes is injected into the second solution under a driving force, each flake can become arranged generally in parallel to the direction of the driving force. In addition, the positive charges of the cationic surfactant and the cations of the second solution can preferably interact with the negative charges on the surface of the graphene oxide flakes and invoke a crosslink reaction bonding the flakes to one another. The chemical bonds between the flakes cause flocculation and generation of the fiber. The graphene oxide fiber can optionally be reduced by use of the acidic reductant to form a reduced graphene oxide fiber. Individual filaments can then be cut to a desired length from the fiber.

In yet another embodiment, a graphene coating on an underlying substrate can be in the form of a single, continuous layer of a single or few-sheet layer of graphene formed on the underlying substrate, e.g., an underlying metal filament formed of a typical TIMS material such as tungsten, rhenium, etc.

The graphene-based material of the TI filament can be further processed to modify and tune the work function of the filament. For instance, the first ionization potential of plutonium is about 6.05 eV. The work function of graphene in comparison is about 4.9-5.2, which is on average slightly higher than that of polycrystalline rhenium (a common traditional filament material), but still somewhat lower than that of plutonium. Through doping and/or chemical modification of the graphene and thereby increasing the work function of the filament to 6 eV or higher, the ionization efficiency of the thermal ionization process can be greatly enhance.

The graphene-based material can be doped with either a p-dopant or an n-dopant, depending upon the particular application of the filament formed by the material and the ionization efficiency of the sample material to be analyzed by use of the system. If the graphene is doped with a p-dopant, electrons flow out of the graphene, thereby increasing the work function of the graphene. On the other hand, if the graphene is doped with an n-dopant, electrons flow into the graphene, thereby reducing the work function of the graphene.

Examples of organic and inorganic dopants for graphene-based materials have been described, for instance in U.S. Patent Application Publication No. 2011/0127471, U.S. Patent Application Publication No. 2014/0087501, and U.S. Pat. No. 9,327,983, all of which being incorporated herein by reference. By way of example, and without limitation, the graphene-based material can be doped with one or more elements that exhibit a high work function such as osmium, tungsten, platinum, etc. Optionally, the graphene-based material can be chemically derivatized, e.g., via the carboxylic acid groups of the graphene oxide, to include desirable functionality for tuning the work function such as, and without limitation, hydroxide groups, carbonyl groups, nitride groups, etc.

In one embodiment, a nicotinamide compound may be used for n-doping of the graphene-based material. For example, a substituted or unsubstituted nicotinamide or a reduction product thereof may be used. In one embodiment, a reduced pyridinium compound can be used for n-doping a graphene-based material. For instance a pyridinium compound that can include at least two pyridinium moieties and includes reduced nitrogen in the ring of at least one of the pyridinium compounds.

In another embodiment, the graphene-based material can be chemically doped with an organic single electron oxidant such as, for example, antimony compounds such as trialkyloxonium hexachloroantimonate ($(C_2H_5)3O+SbCl_6$), antimony pentachloride, nitrosonium salts (for example triethyl oxonium tetrafluoroborate), tris-(pentafluorophenyl) borane and nitrosonium cation. Other single electron oxidants as can be utilized can include, for example, metal organic complexes, pi-electron acceptors, and silver salts. Examples of metal organic complexes include, but are not limited to, tris-(2,2'-bipyridyl) cobalt (III) and tris-(2,2'-bipyridyl) ruthenium (II). Examples of pi electron acceptors include, but are not limited to, tetracyanoquinodimethane, benzoquinone, tetrachlorobenzoquinone, tetrafluorobenzoquinone, tetracynaoethylene, tetrafluoro-tertracyanoquinodimethane, chloranil, tromanil and dichlorodicyanobenzoquinone. Examples of silver salts include, but are not limited to, silver fluoride, and silver trifluoroacetate.

The dopant/modification agent of the graphene can be chemically and/or physically bonded to the surface of the graphene-based material and/or may be chemically and/or physically bonded between layers of the graphene-based material. In addition, the doping and/or chemical modification can take place prior to or following formation of the TI filament.

In one embodiment, a solution doping process can be utilized. According to a solution doping process, the dopant can be dissolved in a solvent such as, and without limitation, dichloromethane, dichloroethane, acetonitrile, chloroform, and mixtures thereof. When considering organometallic dopants, common organic solvents such as acetonitrile, tetrahydrofuran and aromatic hydrocarbons can be employed. When considering inorganic dopants (e.g., silver fluoride), alcohols or an alcohol/water mixture can be employed. A solution doping process can generally be performed at a temperature from about 10° C. to about 100° C. (e.g., about 30° C. to about 100° C.), and the concentration of dopant in the doping solution can generally be from about 1 mM to about 20 mM. The graphene-based material, e.g., the graphene TI filament, can be immersed in the dopant solution for a period of time, generally about 1 hour and then washed and dried.

Referring again to FIG. 1, following formation, the graphene TI filament 10 can be incorporated in a system, e.g., a TIMS system for use in analyzing isotopes of a sample. As shown, the graphene TI filament 10 can be retained, e.g. by use of a brace 12, in electrical communication with conductive elements 14, 15. For instance, the graphene TI filament 10 can be spot welded to each of the conductive elements 14, 15. During use, the sample can be located on the filament, generally in the form of a solid. For instance, a melt or solution including the sample can be applied to the filament, and following cooling and/or removal of any solvent, the solid sample can remain on the filament.

Figure 12:
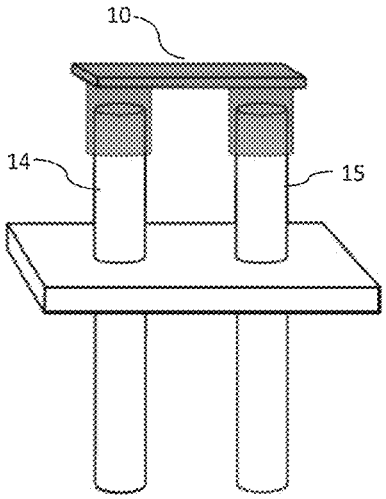
FIG. 12 illustrates another possible electrical connection for a graphene TI filament.

Any suitable connection can be utilized to provide contact between the graphene TI filament 10 and the conductive elements 14, 15. By way of example and without limitations, FIG. 9-FIG. 12 present typical connections including an alligator clip connection (FIG. 9), a friction fit connection (FIG. 10), an embedded strip connection (FIG. 11) and a dog bone connection (FIG. 12).

Figure 13:
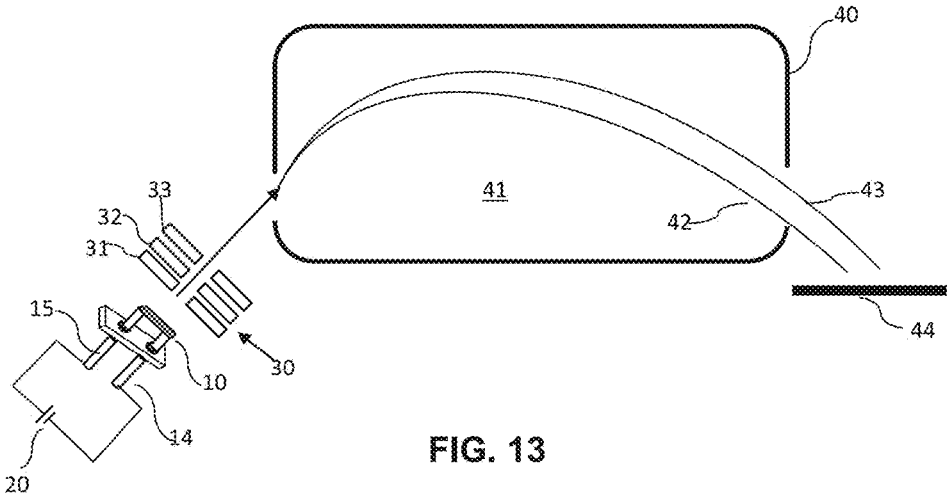
FIG. 13 schematically illustrates one embodiment of a TIMS system including a graphene TI filament as described.

FIG. 13 schematically illustrates a TIMS system that can incorporate the graphene TI filament. As shown, the filament 10 and conductive elements 14, 15 are in electrical communication with a power supply 20. The power supply 20 is not particularly limited. For instance, the power supply can be a direct current source. In other embodiments, the power supply 20 can be a radio frequency power source, a microwave frequency power source, or any other suitable power source as is generally known in the art. The electrical connections between the power supply 20, an electrically conductive elements 14, 15 can be utilized to resistively heat the graphene TI filament 10 to the operating temperature of the system, generally about 1000° C. or greater. For instance, the graphene TI filament 10 can be heated at a current ramp up rate of from about 100 mA/min to about 250 mA/min to a filament current of about 2 A or higher, for instance from about 2 A to about 3 A at which point the sample material located on the filament can spontaneously desorb and ionize via an electron affinity mechanism according to standard thermal ionization methodology.

The system can also include an ion collector 30 and a mass spectrometer 40 according to standard TIMS systems and practice. For instance, the ion collector 30 can include a series of slits and electrostatically charged plates at an electrical potential gradient (e.g., up to about 10 KV) capable of accelerating and focusing the desorbed ions into an ion beam. For example, the ion collector 30 can include a series of lens elements 31, 32, 33 maintained in a vacuum chamber and in electrical communication with a power supply (that can be the same or different as the power supply 20 in communication with the graphene TI filament) that can generally be maintained parallel to one other and axially fixed and spaced so as to establish a series of electric fields to form and accelerate an ion beam toward the magnetic field 41 of the mass spectrometer 40.

The mass spectrometer can be any suitable mass spectrometer as is known in the art such as, for example, a DC quadrupole mass spectrometer, a time of flight mass spectrometer, an ion trap, and orbit trap, etc.

A voltage source (which can be the same or different as the power source 20), can apply RF and DC potentials to the rods of the mass spectrometer, as is known. As the ion beam passes through the magnetic field 41 the original ion beam is dispersed into separate beams on the basis of their mass to charge ratio. These mass-resolved beams 42, 43 are then directed into collectors 44 where each ion beam 42, 43 is converted into a voltage. Comparison of voltages corresponding to individual ion beams 42, 43 can yield precise isotope ratios.

A system can include additional controllers and feedback loops as are generally known in the art. For instance, a controller can be included in communication with the collectors 44 that can adjust the duty cycle of the mass spectrometer based upon the mass and/or ion current being transmitted through the system. In one embodiment, the current of the graphene TI filament 10 can be monitored, and this information can be fed to the power source 20 to control the filament temperature and provide for current regulation. Other ion optical, ion filtering, and/or ion transmission control elements may optionally be included between the ion source filament 10 and the ion collectors 44 as is known in the art.

Moreover, it should be understood that the disclosed methods and systems are not limited to ion collection and analysis, and in some embodiments, the ions formed and optionally separated by use of the disclosed systems can be utilized, for instance to bombard a target, as is known in the art.

The systems including the graphene TI filaments can be used to ionize a wide variety of elemental samples including, without limitation, Pu, U, Th, Pb, Rb, Sr, Sm, Nd, Lu, Hf, Re, Os, Hf, Fe, Ni, Mn, Cr, Al, Mg, Zr, Mo, Ru, Li, B, and Ca. The systems are not limited to such known TI materials, however, as the improved ionization efficiencies afforded by the disclosed systems and methods can open up the TI processes to TI of elements not previously suitable for such methodologies as well as the ability to interrogate much smaller sample sizes than previously thought possible.

While certain embodiments of the disclosed subject matter have been described using specific terms, such description is for illustrative purposes only, and it is to be understood that changes and variations may be made without departing from the spirit or scope of the subject matter.

The invention claimed is:

1. A system for ionizing a sample comprising:

a graphene thermal ionization (TI) filament;

a power source in electrical communication with the graphene TI filament, the power source being configured to resistively heat the graphene TI filament; and an ion collector in communication with the graphene TI filament such that ions emitted from a sample located on the graphene TI filament pass through the ion collector, the ion collector being configured to form an ion beam comprising the ions.

2. The system of claim 1, further comprising a mass spectrometer in communication with the ion collector such that the ions that pass through the ion collector enter a magnetic field of the mass spectrometer.

3. The system of claim 1, wherein the graphene TI filament comprises graphite, graphene, graphene oxide, reduced graphene oxide, or combinations thereof.

4. The system of claim 3, wherein the graphite, graphene, graphene oxide, reduced graphene oxide, or combinations thereof are chemically modified.

5. The system of claim 1, wherein the graphene TI filament comprises graphite, graphene, graphene oxide, reduced graphene oxide, or combinations thereof supported on a metal substrate.

6. The system of claim 1, wherein the graphene TI filament comprises a metal-graphene hybrid.

7. The system of claim 1, wherein the graphene TI filament comprises a dopant.

8. The system of claim 1, wherein the ion collector comprises a series of lens elements.

9. The system of claim 1, wherein the graphene TI filament is a 3-D printed filament.

10. A method for forming an ion beam comprising:

contacting a graphene TI filament with a solid sample;

heating the graphene TI filament to a temperature at which atoms of the solid sample are desorbed and ionized; and collecting and focusing the desorbed ions to form the ion beam.

11. The method of claim 10, further comprising passing the ion beam through a magnetic field and thereby separating the ions of the ion beam according to their mass:charge ratio.

12. The method of claim 10, wherein the graphene TI filament comprises graphite, graphene, graphene oxide, reduced graphene oxide, or a combination thereof.

13. The method of claim 10, wherein the graphene TI filament is a composite graphene TI filament.

14. The method of claim 10, further comprising forming the TI filament.

15. The method of claim 14, wherein the TI filament is formed according to an additive manufacturing process.

16. The method according to claim 15, wherein the additive manufacturing process comprises 3-D printing.

17. The method according to claim 10, further comprising bombarding a target with the ion beam.

18. The method according to claim 10, wherein the solid sample comprises plutonium or uranium.

19. The method according to claim 10, wherein the solid sample comprises Th, Pb, Rb, Sr, Sm, Nd, Lu, Hf, Re, Os, Hf, Fe, Ni, Mn, Cr, Al, Mg, Zr, Mo, Ru, Li, B, or Ca.

* * * * *